US007217030B2

(12) United States Patent
Papi

(10) Patent No.: US 7,217,030 B2
(45) Date of Patent: May 15, 2007

(54) OSCILLATING WEIGHT

(75) Inventor: Alberto Papi, La Chaux-de-Fonds (CH)

(73) Assignee: Vaucher Manufacture Fleurier S.A. (CH)

( * ) Notice: Subject to any disclaimer, the term of this patent is extended or adjusted under 35 U.S.C. 154(b) by 117 days.

(21) Appl. No.: 10/541,287

(22) PCT Filed: Feb. 4, 2004

(86) PCT No.: PCT/IB2004/000400

§ 371 (c)(1),
(2), (4) Date: Jun. 30, 2005

(87) PCT Pub. No.: WO2004/070478

PCT Pub. Date: Aug. 19, 2004

(65) Prior Publication Data

US 2006/0050617 A1 Mar. 9, 2006

(30) Foreign Application Priority Data

Feb. 4, 2003 (EP) ..... 03405056

(51) Int. Cl.
*G04B 3/12* (2006.01)

(52) U.S. Cl. ..... 368/150; 368/152

(58) Field of Classification Search ..... 368/145–153, 368/157, 160, 168, 206–208
See application file for complete search history.

(56) References Cited

U.S. PATENT DOCUMENTS 2,988,869 A * 6/1961 Kocher et al. ..... 368/208
6,409,379 B1 * 6/2002 Gabathuler et al. ..... 368/150

FOREIGN PATENT DOCUMENTS

CH 317 534 A 11/1956

* cited by examiner

*Primary Examiner*—Vit Miska
*Assistant Examiner*—Jeanne-Marguerite Goodwin
(74) *Attorney, Agent, or Firm*—McGlew & Tuttle, PC

(57) ABSTRACT

An oscillating weight for an automatic watch is arranged to carry a bearing defining an axis of rotation (A—A) and is intended to be mounted on the frame of the watch. The mass member of the weight has a center of gravity (G) shifted with respect to the axis of rotation. In this weight, this mass member includes two parts that can be moved one (10, 18) in relation to the other (24), and arranged such that their relative movement causes a radial movement of the center of gravity (G) of the mass member. The mass member also has a securing device (13, 14, 16*b*) cooperating with the first and second parts, capable of occupying a first state in which the parts can be moved with reference to each other, and a second state in which the parts are rigidly secured to each other.

12 Claims, 4 Drawing Sheets

16b
20
24
13
A
A
10
14
24
20
16b
18

22
24
10
10b
12
10a
24
24a
16b
G
10c
26
24b
10d
16a
22
18

OSCILLATING WEIGHT

FIELD OF THE INVENTION

The present invention concerns automatic watches. It relates more particularly to oscillating weights.

BACKGROUND OF THE INVENTION

Automatic watches comprise a movement fitted with a time base, a gear train synchronized by the time base, an energy accumulator, generally a barrel, powering the time base and driving the gear train, and an automatic mechanism supplying energy to the energy accumulator.

Conventionally, this mechanism comprises an oscillating weight, pivotably mounted on the frame of the movement by means of a bearing, a reverser converting the alternating movement of the weight into a rotational movement in one direction, and a winding train, which is of the reduction train type, driven by the reverser. The oscillations of the weight, generated by the movements of the person wearing the watch, thus drive in rotation the winding train, which cooperates with the barrel to wind its spring.

The oscillating weight is arranged to carry a bearing, for example a ball bearing, which defines an axis of rotation. It comprises a mass member whose center of gravity is shifted with respect to the axis of rotation. The mass member is generally designed so as to generate maximum torque. It is made of a heavy material, frequently gold or platinum in top of the range watches. At its periphery, it includes a sector of inertia defining the important part of its weight, and a plate connecting the sector to the bearing.

The oscillating weight generates torque essentially as a function of the weight of the sector and the position of its center of gravity, with reference to the axis of rotation. This torque is applied to the first wheel set of the winding train via the reverser. The reduction rate of the gear train forming the winding train defines the torque finally applied to the barrel spring. When the person wearing the watch is a calm person, arm movements unpoise the weight and it is the terrestrial acceleration g which defines the torque. If the person is very active, the accelerations encountered can be substantially greater. Currently, winding mechanisms are chosen so as to provide spring winding conditions for a normally active person. Consequently, with a very active person, the barrel spring is greatly taxed and the risk of excessive wear cannot be ruled out. If, conversely, the person wearing the watch is very calm, the spring barrel is not wound sufficiently.

SUMMARY OF THE INVENTION

It is an object of the present invention to allow peculiarities of the person wearing the watch to be taken into account in order to improve winding conditions. Therefore, the mass member includes:

- two parts that can be moved in relation to each other, and arranged such that their relative movement causes a radial movement of the center of gravity of the mass member, and
- a securing device, cooperating with the first and second parts, capable of occupying a first state in which said parts can be moved with reference to each other, and a second state in which said parts are rigidly secured to each other.

Owing to the fact that the two parts can be moved in relation to each other and with them, the center of gravity of the weight, it is possible to vary the working conditions of the mechanism and thus adapt it to the user's way of life.

Advantageously, the first part of the oscillating weight further comprises a plate, arranged for carrying the bearing, and a sector of inertia. This plate extends from the center, which is provided with a hole in which the bearing is engaged, towards the periphery which carries the sector of inertia. Certain weights comprise an added sector of inertia, while others are made in one piece.

In a first embodiment, the second part is formed of at least one inertia block pivotably mounted on the sector. Moreover, the securing device includes indexing means arranged for positioning the inertia block in a finite number of predefined positions in which the securing device holds the inertia block when it is in its second state, whereas it allows passage from one of these positions to another when it is in its first state.

In order to increase the correction range and/or the accuracy of such correction, the second part comprises two inertia blocks.

In a variant allowing a high level of adjustment precision, one of the inertia blocks can occupy a finite number n of positions defined such that the passage of said inertia block from one of the positions to another causes a radial movement of the center of gravity of a value $\Delta G$, and so that the second inertia block is arranged so as to be able to occupy a number m of positions where the passage from one position to another causes a radial movement of the center of gravity of a value $\Delta g$, said inertia blocks being arranged such that the product $m.\Delta g$ is substantially equal to $\Delta G$. Consequently, it is possible to define m.n adjustment positions, without the indexing means becoming too complex.

In this embodiment, the moment of inertia of the weight decreases with the torque being generated.

In a second embodiment, the second part of the weight also includes a plate and a sector of inertia, disposed side by side respectively with the plate and the sector of the first part. Moreover, the securing device is arranged so as to allow a relative movement of the second part with reference to the first part by rotation about the axis of the oscillating weight.

Other advantages and features of the invention will appear from the following description, made with reference to the annexed drawing. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 1A, 1B:
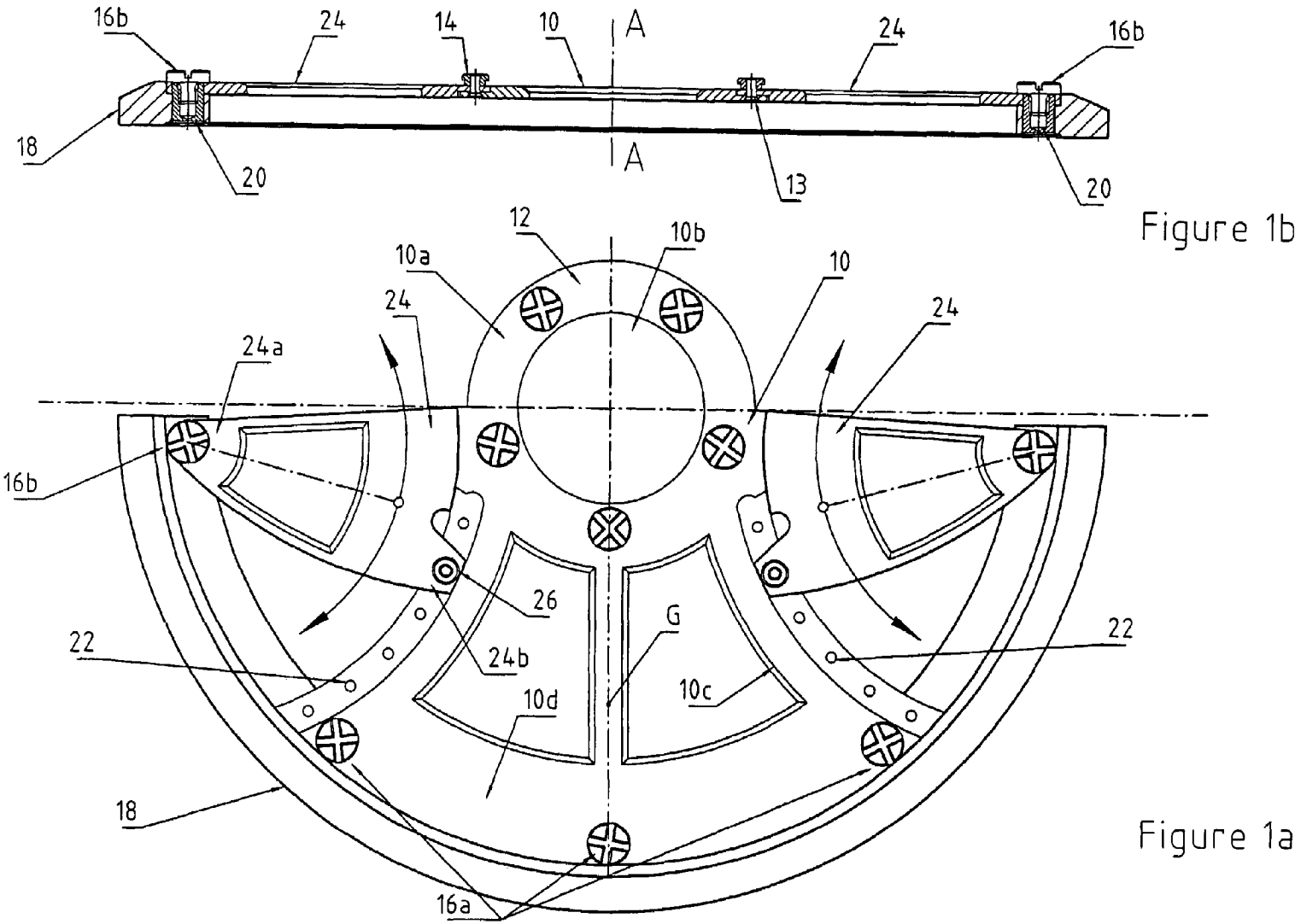
FIG. 1*a* is a top view in accordance with a first embodiment of the invention.
FIG. 1*b* is a cross-sectional view in accordance with the first embodiment of the invention.
Figure 1C:
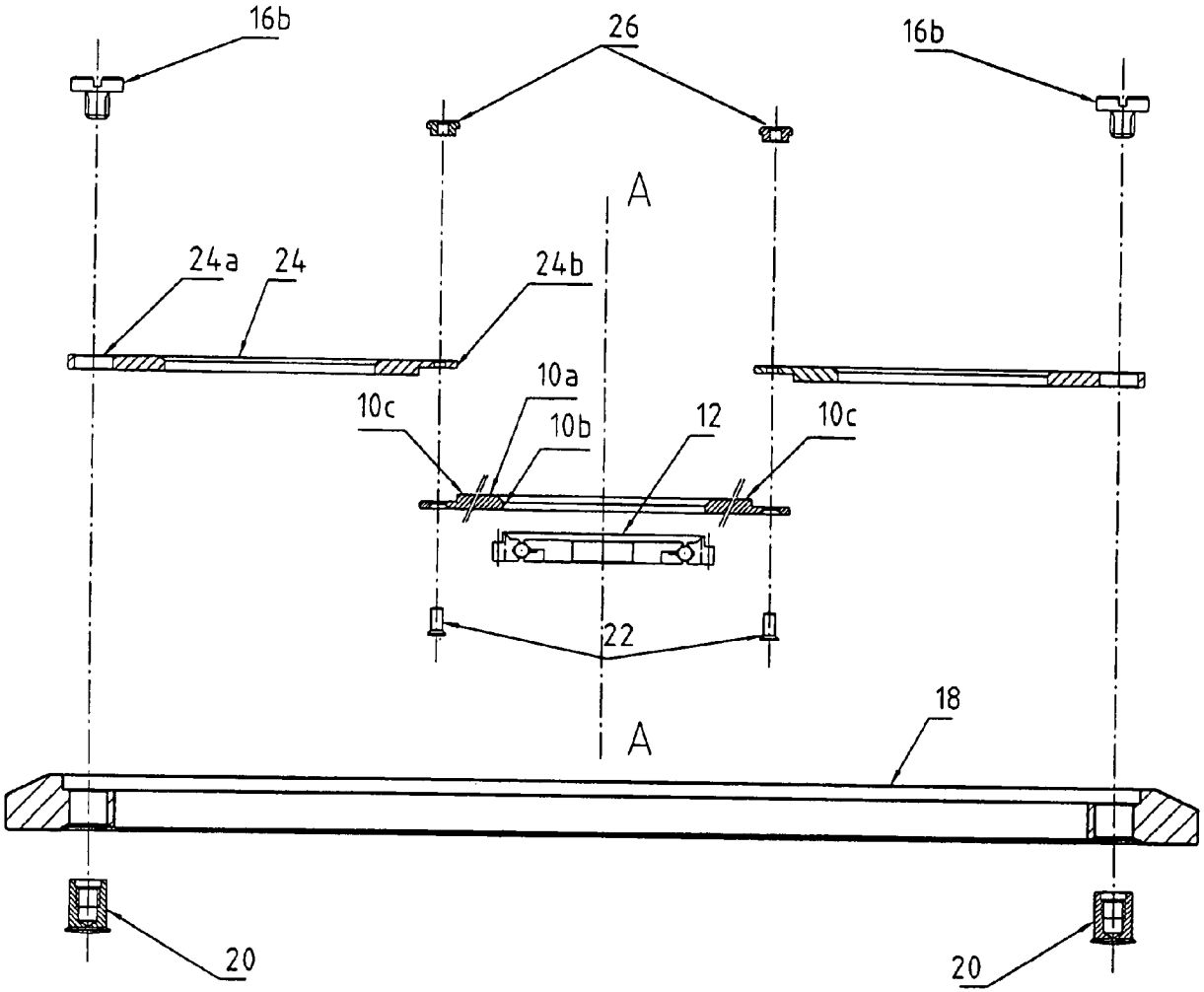
FIG. 1*c* is an exploded view showing an oscillating weight in accordance with the first embodiment of the invention.

The weight shown in FIG. 1 includes a plate 10 comprising a central portion 10*a* of generally annular shape, provided with a central aperture 10*b* for receiving a bearing 12 that is partially shown, for example a ball bearing, and arms 10*c* extending radially outwards. The central aperture 10*b* is circular, defined by a circle of axis A—A.

In its central portion 10*a*, plate 10 carries, arranged in a ring, threaded pins 13 for securing bearing 12 by means of bolts 14.

At their periphery, arms 10*c* are connected by an annular center portion 10*d* disposed on axis A—A. It is provided with three holes in which screws 16*a* are engaged.

A sector of inertia 18, in the form of an annular portion, is provided with five threaded feet 20. It is secured to plate 10 by means of screws 16*a* engaged in three of threaded feet 20. It is advantageously made of a heavy material, for example gold or platinum in top of the range watches, of brass for more common products. It extends over an angle of approximately 180°. The function of the two other threaded feet 20 will be specified hereinafter.

Plate 10 is only secured to sector 18 over an angle of approximately 90°, via its annular portion 10*d*. The edges of arms 10*c* connecting central portion 10*a* to annular portion 10*d* are also in the arc of a circle, the centers of which are each at one of the ends of sector 18, identical to the centers of the two other threaded feet 20. These edges each carry six regularly distributed threaded feet 22.

One of inertia blocks 24 is mounted on each of end feet 20. They have the general shape of a sector of a circle and include, at the apex 24*a* of the sector, a cylindrical hole in which threaded foot 20 is engaged, and a screw 16*b* for axial holding. The opposite side is provided with a finger 24*b* including an aperture to be engaged in one or other of threaded feet 22. A nut 26 is screwed onto foot 22 in order to hold inertia block 24 via its finger 24*b*.

In this oscillating weight, the sector of inertia 18 and plate 10 form a first part of a mass member, and inertia blocks 24 a second part, the center of gravity of said member being located at G. Screws 16, threaded feet 20 and threaded feet 22, and nuts 26 act as the securing device, which, depending upon whether its constituent parts are in an unscrewed or screwed state, allows or prevents the movement of inertia blocks 24 with reference to sector of inertia 18 and plate 10. Moreover, the threaded feet index inertia blocks 24, so that the latter can occupy a determined number of positions.

With the weight thus described, it is possible to vary by several percent the torque that it applies to the gear train in order to rewind the motor spring of the watch. The position of one or other of the two inertia blocks 24 has only to be altered. The center of gravity G is shifted further with respect to axis A—A and, consequently, the torque is greater when the ends fitted with finger 24*b* of inertia blocks 24 are in proximity to sector 18. Conversely, by returning finger 24*b* so that it is engaged in a foot 22 close to central portion 10*a*, the center of gravity if shifted towards axis A—A, so that the torque is reduced.

Any horologist trained for this purpose can adjust the torque. In order to guarantee optimum working conditions, a first adjustment can be made when the watch is sold, by classifying the person that it is for with reference to his or her physical activities, both professional and leisure activities. On this basis, the instructions for the watch define the position in which the inertia blocks should be located. After several days wear, it is possible to check whether the position selected is correct. In order to carry out the adjustment, one has only to unscrew screws 16*b* and nuts 26 to be able to move inertia blocks 24, then screw them back in again when inertia blocks 24 are in the chosen position.

In order to make the most accurate adjustment possible, one could envisage using inertia blocks that do not have the same features. One of them can occupy a finite number n of positions defined such that passage from one position to another generates a radial movement of the center of gravity of a value $\Delta G$. The second inertia block is arranged so as to be able to occupy a number m of positions where passage from one position to another generates a radial movement of the center of gravity of a value $\Delta g$. The inertia blocks are sized such that the product $m.\Delta g$ is substantially equal to $\Delta G$. Consequently, an accurate correction can be made.

The embodiment described hereinbefore has to be only slightly altered in order to achieve this result. The dimensions (thickness, length particularly) of one of the inertia blocks have only to be reduced in an appropriate manner to obtain the desired effect. This operation is easily accessible to those skilled in the art.

Adjustment can occur particularly easily in a watch fitted with a power reserve. Then, one only needs to establish a correlation between the movement of the inertia blocks and the degree of winding of the spring.

Figure 2B:
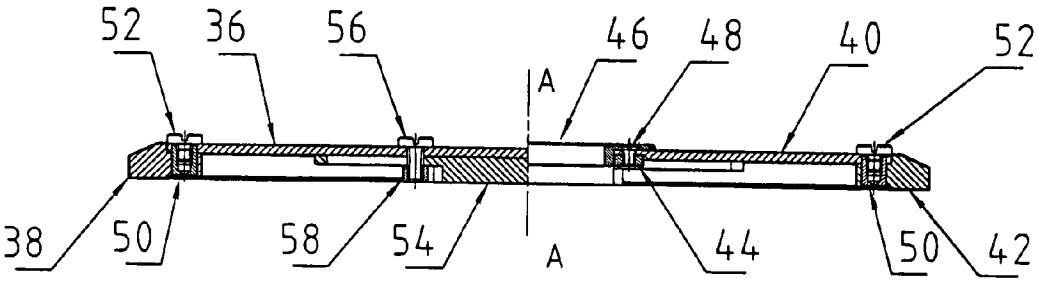
FIG. 2*b* is a cross-sectional view showing an oscillating weight in accordance with the second embodiment of the invention.
Figure 2A:
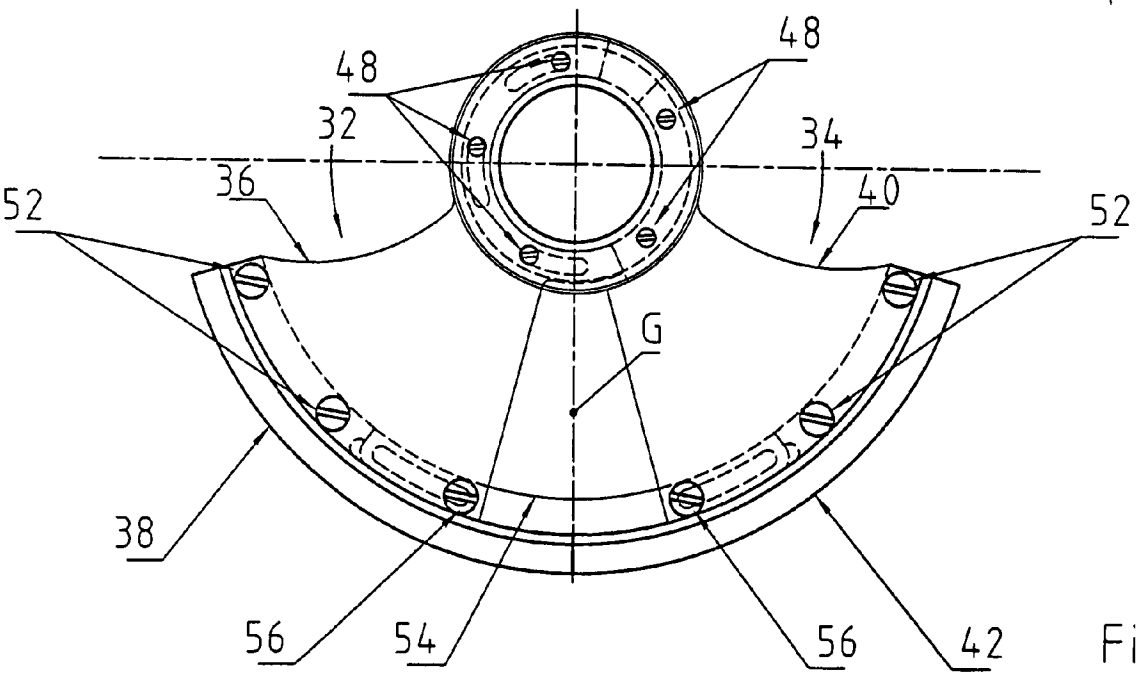
FIG. 2*a* is a plan view showing an oscillating weight in accordance with a second embodiment of the invention.

In the embodiment described with reference to FIG. 1, the moment of inertia increases at the same time that the center of gravity of the weight is moved. It is also possible to change the position of the center of gravity while keeping the same moment of inertia. This is permitted by the embodiment shown in FIG. 2, which shows a weight shown in plan at 2*a* and in cross-section at 2*b* and blown up at 2*c*.

This weight includes first and second parts 32 and 34 each including a plate and a sector of inertia, respectively referenced 36 and 38 for the first part 32 and 40 and 42 for the second part 34.

Figure 2C:
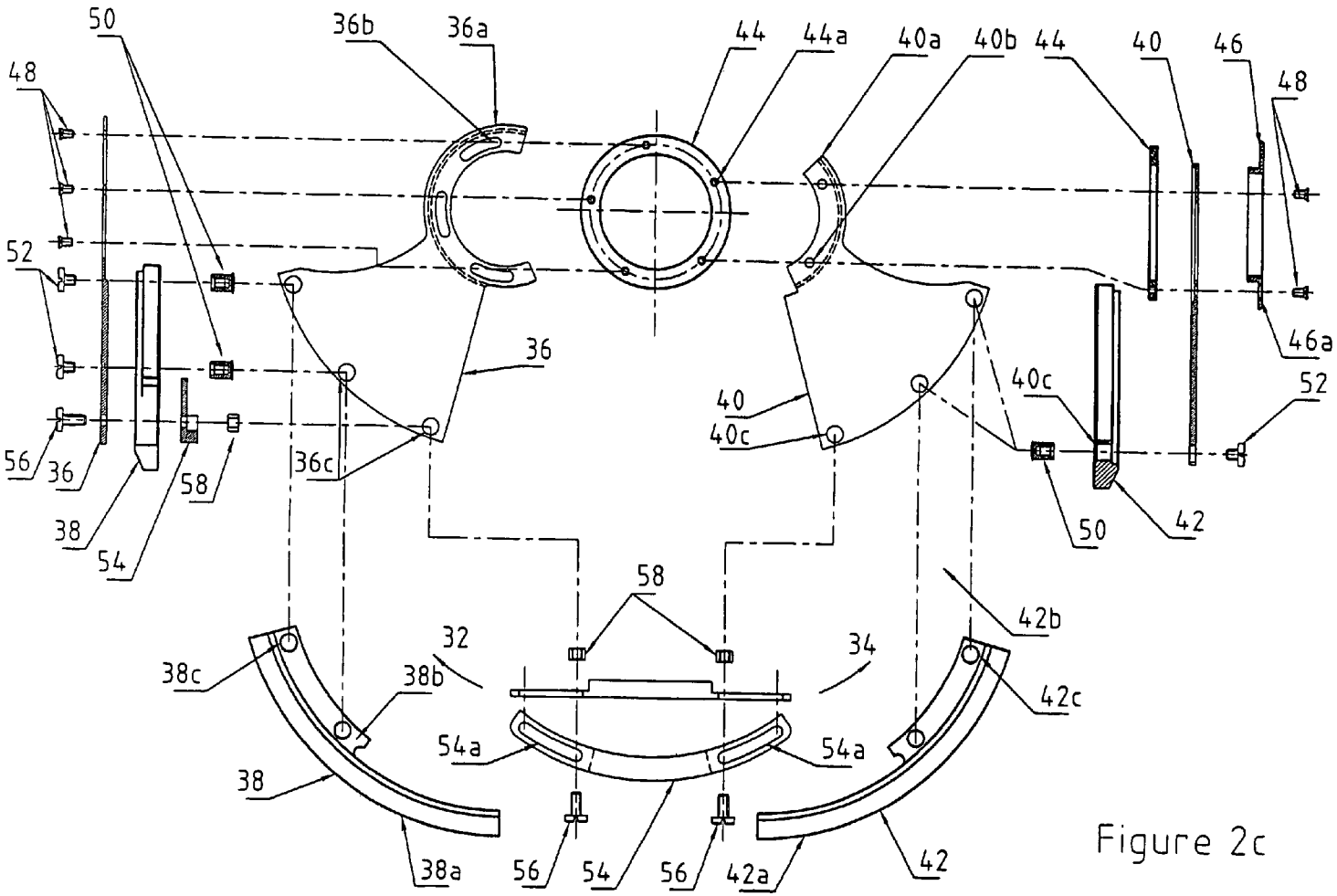
FIG. 2*c* is an exploded view showing an oscillating weight in accordance with the second embodiment of the invention.

Plates 36 and 40 have the general shape of a sector of a circle, with an apex angle of approximately 45°. The apex part is cut to form an annular portion identified by the letter a, covering an angle of approximately 200° for portion 36*a* and approximately 90° for portion 40*a*, as can be seen in FIG. 2*c*. These portions are pierced with holes identified by the letter b, three oblong holes in portion 36*a* and two cylindrical holes in portion 40*a*.

The two plates are assembled to each other by means of a securing device comprising a tightening ring 44 provided with threaded holes 44*a*, and arranged below portions 36*a* and 40*a*, a cover 46 placed above portions 36*a* and 40*a*, provided with cylindrical holes 46*a* aligned on holes 44*a*, and screws 48 freely engaged in the holes of cover 46 and annular portions 36*a* and 40*a*, and tightened in threaded holes 44*a* of tightening ring 44.

Since plate 36 is provided with oblong holes, it is possible to move it angularly with reference to plate 40, about an axis corresponding to the pivoting axis A—A of the weight, if screws 48 are unscrewed.

Plates 36 and 40 are each pierced with three holes identified by the letter c, made at the periphery of the sector of the circle. Their function will be specified hereinafter.

Sectors of inertia 38 and 42 each include an annular portion, identified by the letter a and covering an angle of approximately 80°, and a shoulder b attached to the annular portion a in its concave part. Shoulder b, which extends over approximately 45, acts as a support for the plate. It is provided with two cylindrical holes, identified by the letter c, in which are engaged, for each of them, a tightening stud 50, which is provided with a threaded hole. Two screws 52 are engaged in two of holes c of plates 36 and 40 and in studs 50 in which they are tightened. Plates 36 and 40 are, consequently, respectively secured to sectors 38 and 42.

In a variant, sectors 38 and 42 could also be integral respectively with plates 36 and 40, or welded to each other.

With the structure that has just been described, it may happen that plates 36 and 40 lack rigidity. Thus, in order to better secure the two parts to each other, the securing device further includes a stiffening arm 54, in the form of an annular portion covering an angle of approximately 90°, disposed in the extension of shoulders 38*b* and 42*b*. This arm includes two oblong apertures 54*a* each disposed facing the third hole of the plates. A screw 56, cooperating with a nut 58, is engaged in each of these holes and in holes 36*c* and 40*c* that are not occupied by screws 52, such that, by tightening the screw and its nut, it is possible to secure the two parts rigidly to each other.

Numerous variants of the two embodiments described hereinbefore can of course be envisaged. The solutions described largely rely on screws, which is a particularly simple solution to implement for making single pieces or prototypes. In the case of large-scale manufacture, one could envisage using other locking systems, for example snap-fit systems, or any other means known to those skilled in the art. The two constituent parts of the weight could also have very different shapes, and have dimensional ratios that vary considerably, as a function of the relative movement possible and the desired range of adjustment.

It would also be possible to design a weight in accordance with the second embodiment fitted with an inertia block as defined in the first embodiment, so as to allow a rough adjustment with relative movement of the two parts, then a finer adjustment by adjusting the position of the inertia block.

Thus, owing to the fact that the weight according to the invention has two parts that are mobile with reference to each other, their movement inducing a change in radial position of its center of gravity, it is possible to optimize the working conditions of automatic watches and thus obtain optimum yield for a minimum volume, whatever the conditions imposed by the person wearing the watch.

While specific embodiments of the invention have been shown and described in detail to illustrate the application of the principles of the invention, it will be understood that the invention may be embodied otherwise without departing from such principles.

The invention claimed is:

1. An oscillating weight for an automatic watch, arranged to carry a bearing defining an axis of rotation and intended to be mounted on a frame of the watch, including a mass member having a center of gravity shifted with respect to the axis of rotation, said member comprising:

two parts that can be moved one in relation to the other, and arranged such that their relative movement causes a radial movement of the center of gravity of the mass member, and a securing device cooperating with the first and second parts, capable of occupying a first state in which said parts can be moved with reference to each other, and a second state in which said parts are rigidly secured to each other.

2. An oscillating weight according to claim 1, wherein said first part includes a plate arranged for carrying said bearing and a sector of inertia rigidly fixed to the plate.

3. An oscillating weight according to claim 2, wherein said second part is formed of at least one inertia block pivotably mounted on said sector and in that said securing device includes indexing means arranged for positioning said inertia block in a finite number of predefined positions in which said device holds said inertia block when said device is in its second state, whereas said device allows passage from one of these positions to another when said device is in its first state.

4. An oscillating weight according to claim 3, wherein the second part includes two inertia blocks.

5. An oscillating weight according to claim 4, wherein one of the inertia blocks can occupy a finite number n of positions, defined such that the passage from one of the positions to another generates a radial movement of the center of gravity of a value $\Delta G$, and in that said second inertia block is arranged so as to be able to occupy a number m of positions where the passage from one position to another generates a radial movement of the center of gravity of a value $\Delta g$, said inertia blocks being arranged so that the product $m.\Delta g$ is substantially equal to $\Delta G$.

6. An oscillating weight according to claim 2, wherein said second part also includes a plate and a sector of inertia, disposed respectively side by side with the plate and the sector (38) of the first part, and in that the securing device is arranged to allow, in its first state, a relative angular movement of the second part with reference to the first part by rotation about said axis.

7. An oscillating weight for an automatic watch, the weight comprising a mass element with a bearing portion defining an axis of rotation and a remaining mass portion defining an outer radial extent, the mass element having a center of gravity shifted radially outwardly with respect to the axis of rotation, the mass element comprising:

a first part;

a second part movable relative to the first part and arranged such that the relative movement causes a radial movement of the center of gravity of the mass element, and a securing device cooperating with the first part and second part, said securing device occupying a first state in which said second part can be moved with reference to said first part and a second state in which said second part is rigidly secured to said first part.

8. An oscillating weight according to claim 7, wherein said first part includes a plate arranged for carrying said bearing portion and a sector of inertia rigidly fixed to the plate.

9. An oscillating weight according to claim 8, wherein said second part is formed of at least one inertia block pivotably mounted on said sector of inertia; and said securing device includes indexing means arranged for positioning said inertia block in a finite number of predefined positions in which said device holds said inertia block when said device is in its second state, whereas said device allows said second part to be moved with reference to said first part from one of these positions to another when said device is in said first state.

10. An oscillating weight according to claim 8, wherein said second part includes two inertia blocks.

11. An oscillating weight according to claim 10, wherein one of the inertia blocks can occupy a finite number n of positions, defined such that the passage from one of the positions to another generates a radial movement of the center of gravity of a value $\Delta G$, and in that said second inertia block is arranged so as to be able to occupy a number m of positions where the passage from one position to another generates a radial movement of the center of gravity of a value $\Delta g$, said inertia blocks being arranged so that the product $m.Dg$ is substantially equal to $\Delta G$.

12. An oscillating weight according to claim 8, wherein said second part also includes a plate and a sector of inertia, disposed respectively side by side with the plate and the sector of the first part, and in that the securing device is arranged to allow, in said first state, a relative angular movement of the second part with reference to the first part by rotation about said axis.

* * * * *